US009666425B2

(12) United States Patent
Lesch et al.

(10) Patent No.: US 9,666,425 B2
(45) Date of Patent: May 30, 2017

(54) GAS DISCHARGE LAMP

(75) Inventors: Norbert Lesch, Vaals (NL); Manfred Westemeyer, Aldenhoven (DE); Klaus Schoeller, Nideggen (DE)

(73) Assignee: KONINKLIJKE PHILIPS N.V., EINDHOVEN (NL)

( * ) Notice: Subject to any disclaimer, the term of this patent is extended or adjusted under 35 U.S.C. 154(b) by 1614 days.

(21) Appl. No.: 11/722,809

(22) PCT Filed: Dec. 22, 2005

(86) PCT No.: PCT/IB2005/054387

§ 371 (c)(1),
(2), (4) Date: Jun. 26, 2007

(87) PCT Pub. No.: WO2006/085162

PCT Pub. Date: Aug. 17, 2006

(65) Prior Publication Data

US 2008/0093992 A1 Apr. 24, 2008

(30) Foreign Application Priority Data

Jan. 3, 2005 (EP) ..... 05100005

(51) Int. Cl.
*H01J 61/06* (2006.01)
*H01J 17/18* (2012.01)
*H01J 61/54* (2006.01)

(52) U.S. Cl.
CPC ..... *H01J 61/547* (2013.01)

(58) Field of Classification Search
CPC ..... H01J 61/547
(Continued)

(56) References Cited

U.S. PATENT DOCUMENTS 4,053,809 A * 10/1977 Fridrich et al. ..... 313/594
5,661,367 A * 8/1997 Fellows et al. ..... 315/59
(Continued)

FOREIGN PATENT DOCUMENTS

CN 1471723 A 1/2004
EP 0938127 A1 8/1999
(Continued)

OTHER PUBLICATIONS

EPO as ISA, PCT/IB2005/054387 filed Dec. 22, 2005, International Search Report and Written Opinion mailed Jun. 23, 2006, 11 pages.
(Continued)

*Primary Examiner* — Nimeshkumar Patel
*Assistant Examiner* — Jacob R Stern

(57) ABSTRACT

A gas discharge lamp has an inner bulb with a discharge vessel with two sealing sections thereon, from which electrodes protrude into the discharge vessel, each electrically connected with a conductor in the associated sealing section to supply current to the electrodes. The lamp also has an outer bulb surrounding the discharge vessel, leaving a cavity therebetween. Close to at least one of the electrodes in or near a transitional area between the discharge vessel and the associated sealing section on an outside of the inner bulb is arranged potential-free a conductive structure which on application of a voltage to the electrodes influences the electrical field adjacent the electrodes such that a discharge arc travels from the electrode first in the direction of a wall section of the discharge vessel adjacent the electrode and then over the inside of the wall toward the other electrode.

7 Claims, 5 Drawing Sheets

Figure 1:
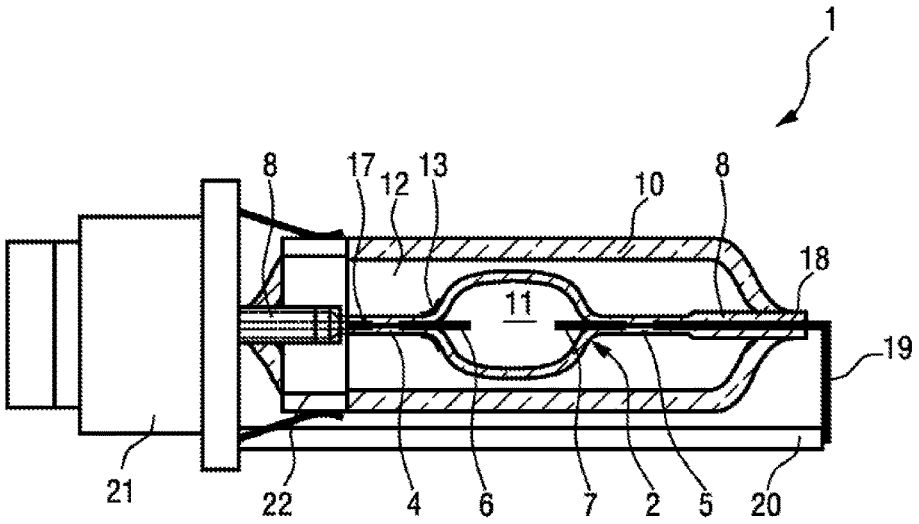

(58) Field of Classification Search
USPC ..... 313/624, 623, 625, 594; 315/330
See application file for complete search history.

(56) References Cited

U.S. PATENT DOCUMENTS

| | | | | |
|---|---|---|---|---|
| 5,955,845 | A * | 9/1999 | Fellows | 315/189 |
| 6,020,685 | A * | 2/2000 | Wei et al. | 313/625 |
| 6,172,462 | B1 | 1/2001 | Gibson et al. | |
| 6,201,348 | B1 | 3/2001 | Nortrup et al. | |
| 6,268,697 | B1 * | 7/2001 | Nishida et al. | 313/607 |
| 6,404,129 | B1 | 6/2002 | Hendrix et al. | |
| 6,538,377 | B1 | 3/2003 | Scott et al. | |
| 6,624,580 | B2 | 9/2003 | Kanegae et al. | |
| 6,674,239 | B1 | 1/2004 | Westemeyer et al. | |
| 2002/0185973 | A1 | 12/2002 | Jackson et al. | |
| 2003/0127985 | A1 * | 7/2003 | Okamoto et al. | 313/594 |
| 2006/0076893 | A1 * | 4/2006 | Murakami et al. | 313/607 |
| 2006/0125404 | A1 * | 6/2006 | Budinger | 315/82 |
| 2006/0208641 | A1 * | 9/2006 | Maniwa et al. | 313/623 |

FOREIGN PATENT DOCUMENTS

| | | | |
|---|---|---|---|
| EP | 0990248 | B1 | 4/2000 |
| EP | 1069596 | A2 | 1/2001 |
| EP | 1355345 | A1 | 10/2003 |
| JP | 63190245 | A | 8/1988 |
| JP | 05105979 | A | 4/1993 |
| JP | 0620645 | A | 1/1994 |
| JP | 06196128 | A | 7/1994 |
| JP | 06290754 | A | 10/1994 |
| JP | 10134773 | | 5/1998 |
| JP | 2002304968 | A | 10/2002 |
| JP | 2002543576 | A | 12/2002 |
| JP | 2004193061 | A | 7/2004 |
| WO | 0159811 | A1 | 8/2001 |
| WO | 2004051700 | A1 | 6/2004 |

OTHER PUBLICATIONS

First Office Action issued Jul. 24, 2009, China Application No. 200580045767.5, 17 pages.
Notification to Grant issued Jul. 15, 2010, China Application No. 200580045767.5, 3 pages.
Office Action dated Dec. 10, 2015, European Application No. 05826169.4, 4 pages.
Rejection Notification mailed Sep. 10, 2012, Japan Application No. 2007-548946, 7 pages.
Rejection Notification mailed Sep. 12, 2011, Japan Application No. 2007-548946, 9 pages.
Second Office Action issued Feb. 5, 2010, China Application No. 200580045767.5, 8 pages.

* cited by examiner

GAS DISCHARGE LAMP

This application claims priority to PCT Application No. PCT/IB2005/054387, filed Dec. 22, 2005, which itself claimed priority to European patent application Serial No. 05100005.7, filed Jan. 3, 2005.

The invention relates to a gas discharge lamp with an inner bulb with a discharge vessel and two sealing sections arranged on the discharge vessel, with two electrodes protruding from the sealing sections into the discharge vessel which are each electrically connected in the corresponding sealing section with a conductor in order to supply current to the electrodes, and with an outer bulb which surrounds the discharge vessel leaving a cavity between the discharge vessel and the outer bulb. In addition the invention concerns a headlamp with such a gas discharge lamp and a method for igniting such a gas discharge lamp.

Gas discharge lamps constructed in the manner cited initially are usually high pressure gas discharge lamps such as for example high pressure sodium lamps or in particular MPXL (micro power xenon light) lamps. In such lamps the discharge vessel (normally also known as a "burner") holds only a few microliters of gas. The outer bulb which is sealed to the surrounding atmosphere is usually filled with gas—frequently with air—or evacuated. It serves primarily to absorb the ultraviolet radiation occurring amongst others on discharge. The efficiency of such lamps with regard to light generation is higher, the higher the pressure of the inert gas in the discharge vessel. Unfavorably a higher pressure of the inert gas means that gas ignition is more difficult. As such lamps are preferably used in vehicle headlamps, for safety reasons it is necessary for the lamps to start reliably within a very short time after switching on. Therefore relatively high ignition voltages must be applied to ensure starting when both cold and hot e.g. if the lamp is restarted immediately after being switched off. This requires relatively powerful, complex and hence expensive and constructionally large igniter circuits. In addition due to a high ignition voltage, the problem of electromagnetic interference caused by the lamp in other components in the electronic system of the vehicle is greater. Therefore greater measures must also be taken to screen or avoid the electromagnetic interference pulses caused by the start process.

It has been known for some time that the ignition voltage on high pressure discharge lamps can be substantially reduced using a device usually known as a starting aid antenna. EP 1 069 596 A2 describes antennae which are guided along the discharge vessel or in a loop about the discharge vessel and laid to a positive potential. These function as a type of auxiliary electrode which causes the electrical field inside the discharge vessel to be distributed more evenly. The construction of these auxiliary electrodes is normally relatively complex and therefore frequently too expensive for mass production.

It is an object of the present invention to create an alternative to the gas discharge lamps known from the prior art which can be produced with low complexity and cost and guaranteed starting of the lamp even with a reduced ignition voltage.

This object is achieved by a gas discharge lamp as claimed.

According to the invention close to at least one of the two electrodes in the transitional area between the discharge vessel and the associated sealing section, or at a short distance from this transitional area (for example, on the pinch, or directly behind the pinch as seen from the discharge vessel) on the outside of the inner bulb is arranged potential-free a conductive structure which on application of a voltage to the electrodes influences the electrical field present in the area of the electrode concerned such that a discharge arc travels from the electrode concerned first in the direction of a wall section of the discharge vessel adjacent to the electrode and then over the inside of the wall towards the other electrode. The term "arranged potential-free" means that the conductive structure is insulated from the electrodes and their supply lines or from other electrical conductors or ground potentials and hence does not lie to an externally specified potential.

A suitable distortion or increase of the field strength at the quartz wall of the electrical field occurring on application of the ignition voltage ensures that first a breakthrough is initiated from the contact area between the electrode and the quartz wall of the discharge vessel. This discharge then extends over the inside of the quartz wall of the discharge vessel towards the other electrode so that the desired ignition is achieved between the electrodes. It has been found that such a discharge is possible substantially more easily over the surface of the quartz wall than as a direct discharge between the electrodes even though that is actually the shortest path for the discharge. This is because in a surface discharge—i.e. a discharge along a surface—more efficient physical mechanisms can be used to generate electrons and other free charge carriers than with a volume discharge through the middle of the discharge vessel. The invention thus deviates from the known prior art in that no direct attempt is made to generate an even electrical field between the electrodes but by using the conductive structure in the vicinity of at least one of the two electrodes in the transitional area between the discharge vessel and the associated sealing section, or at a short distance from this transitional area, the field lines are suitably distorted so that a discharge arc is generated first towards the wall—deviating from the discharge path actually desired—in the direction of the wall.

By application of the conductive structure in the transitional area between the sealing section and the discharge vessel it is also ensured that the light emerging on later operation of the lamp is not obstructed or otherwise influenced by the conductive structures on the inner bulb.

The dependent claims each contain advantageous embodiments and refinements of the invention.

Particularly preferably, the conductive structure is generated by application of a conductive coating, for example a conductive paint to the inner bulb, or a coating comprising small conductive areas and/or elements, isolated from each other, for example a paint which comprises a number of conductive particles either singly or clustered together to give small conductive regions (e.g. in the range of nanometers or below). In other words, the paint or coating itself is not conductive in the sense that it would have a low electrical resistance and allow a current to flow through the coating. However, it does provide the desired potential-free conductive structure, since the conductive particles suffice to influence the electric field according to the invention. Therefore, the terms "conductive structure" and "conductive material" are to be interpreted to mean a structure or material built up in this way.

Such a method, using a coating, is extremely simple and economic. It should merely be ensured that a coating is selected which permanently resists the high temperature of the gas discharge lamp of around 1000° C., i.e., depending on the distance from the discharge vessel, the conductive structure must withstand temperatures from, e.g., 600° C. or more. Suitable materials are however known to the expert. For example a paint comprising platinum, zirconium, rhenium, palladium could be used. Also less temperature-resistant materials such as gold and silver can be used if these are given a protective coating against vaporization (e.g. silicon oxide, zirconium oxide).

The invention is used particularly advantageously in mercury-free gas discharge lamps i.e. in lamps in which the gas filling of the discharge vessel contains no mercury. In mercury-containing discharge lamps, in the cold state mercury precipitates on the inner wall of the discharge vessel. This leads to a conductive coating. This conductive coating can help create a surface discharge over the wall on start up. However operating conditions are known in which the mercury deposits on the electrodes. Therefore the use of the invention also in mercury-containing high pressure gas discharge lamps is useful.

In several tests it has been found that in a very simple and well-functioning embodiment one conductive structure is sufficient on the inner bulb that encompasses the electrode in the form of a ring. In other words, a simple annular strip is applied on the inner bulb, preferably directly in the transitional area between the discharge vessel and sealing area (pinch area) or adjacent or at a short distance from the transitional area (for example on the pinch or directly behind the pinch as seen from the discharge vessel). Particularly preferably the ring is arranged at a position at which the distance to an end section of the electrode freely located in the discharge vessel is minimal. This simple measure of a potential-free "ring antenna" running around the electrode already leads to a substantial reduction in the required start-up voltage of on average 18.5 kV to on average 15.3 kV. In other words, a reduction of more than 3 kV is achieved. At the same time, the reliability of the start-up process is substantially increased. While a lamp without this simple conductive ring structure on average requires 6.4 pulses to start, a lamp according to the invention with such a conductive structure usually requires only a single pulse for starting.

In an alternative preferred embodiment, a strip of conductive coating or a coating comprising isolated conductive elements is applied to the pinch region, parallel to the lead.

In a further alternative preferred embodiment example conductive structures are arranged on the outside of the inner bulb in both transitional areas between the discharge vessel and the two sealing sections concerned or at a short distance from these transitional areas. Preferably the discharge vessel is constructed symmetrically at least in relation to the conductive structures. For example, about each electrode on the outside of the inner bulb is arranged a simple, potential-free conductive ring structure as previously described for one electrode side.

In principle, the two conductive structures can also be connected together for example by strips made from conductive material or a material comprising isolated conductive areas, running longitudinally over the discharge vessel or other conductive structures arranged in the centre area on the discharge vessel. However it should be ensured that the entire conductive structure is still potential-free i.e. not electrically conductively connected with one of the electrodes or ground. Similarly it should be ensured that the structure does not take up too much space on the discharge vessel in order not to influence the light radiation.

The connection between the two end conductive structures on the sealing sections is preferably achieved by a relatively thin strip which is sufficient to distort the field in this direction, but not wide enough for the light generated in the inner bulb to be lessened during operation. Thus a conductive material transparent in the frequency range of the emitted light could be used.

In a preferred variant of such a lamp which has conductive structures in both transitional areas between the discharge vessel and the respective sealing sections, the two structures are however electrically isolated from each other. In a preferred refinement of this variant also the cavity between the outer bulb and the inner bulb is filled with a gas. This gas is preferably an inert gas or a mixture of inert gases but may also simply be air. Possible combinations also include gases from the group $F_2$, $Cl_2$, $Br_2$, $I_2$, $N_2$, $O_2$.

Where it is ensured that the gas pressure in the outer bulb is not too high, for example below atmospheric pressure, a pre-discharge occurs in the outer bulb between the two conductive structures on the outside of the inner bulb which are coupled high frequency capacitatively with the electrodes. This means that between the two conductive structures not electrically connected together on the inner bulb, a glow discharge is formed in the interior of the outer bulb which runs along the discharge vessel and acts as a so-called "plasma antenna". This also leads to influencing of the electrical field applied between the electrodes in the direction of the wall of the discharge vessel so that a reduction in breakthrough voltage is achieved. This measure of a potential-free ring antenna running about one or both electrodes in connection with a suitable gas mixture—preferably e.g. NeAr, 1 kPa or $ArN_2O_2$, 15 kPa—leads to a very substantial reduction in the start up voltage required from on average 18.5 kV to less than 13 kV. I.e. a reduction of more than 5 kV is achieved. Also usually only one ignition pulse is required. After finally the discharge has ignited in the interior of the discharge vessel, the potential difference at the conductive structures coupled merely capacitatively with the electrodes is no longer sufficient so that the discharge in the outer bulb is extinguished again.

Due to such a cascade discharge in which the actual desired discharge in the discharge vessel is supported by a pre-discharge in the outer bulb, the ignition voltage can consequently also be reduced, where—in contrast to a conductive structure which extends over the outside of the discharge vessel—the light on later operation of the lamp is not disrupted by a conductive antenna structure, for example made from metallic paint or other coating.

Particularly preferably, therefore, the pressure in the cavity between the discharge vessel and the outer bulb is set no lower than around 0.1 kPa and no higher than around 100 kPa. Particularly preferably, the pressure is higher than 40 kPa, since for settings above this pressure the heat dissipation within the gas is still sufficient not to shorten the life of the lamp. Particularly preferably, the pressure also lies below 80 kPa. In this case the pressure in the inner bulb even on heating of the lamp does not rise beyond the pressure at which a special seal of the outer bulb to the inner bulb would be necessary. The ideal filling pressure with regard to ignition properties is determined using the Paschen curve. It is accessible as a free parameter, in contrast to which the geometric dimensions are prespecified by the design of the gas discharge lamp.

Figure 2:
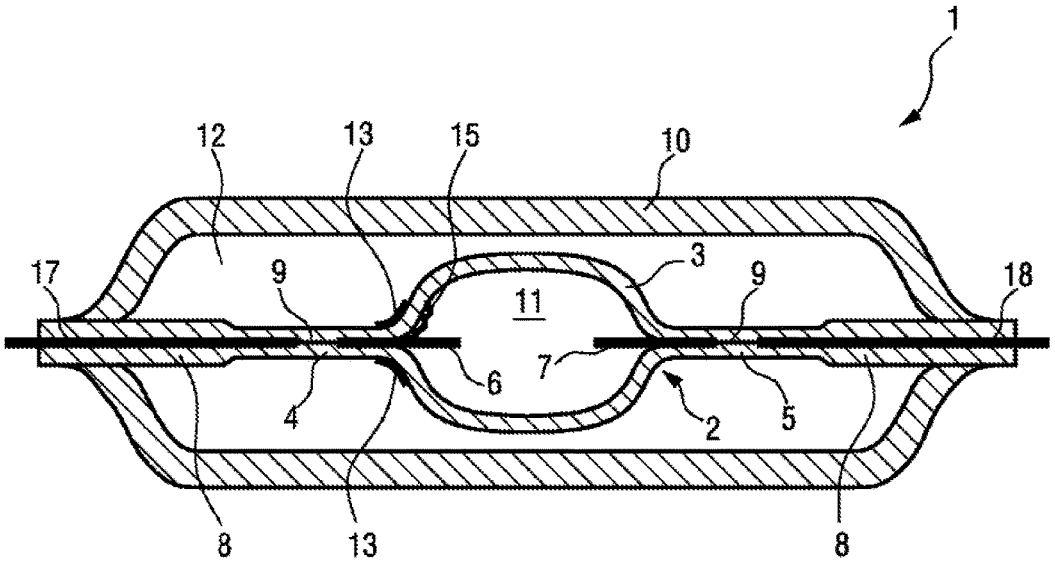
Figure 3:
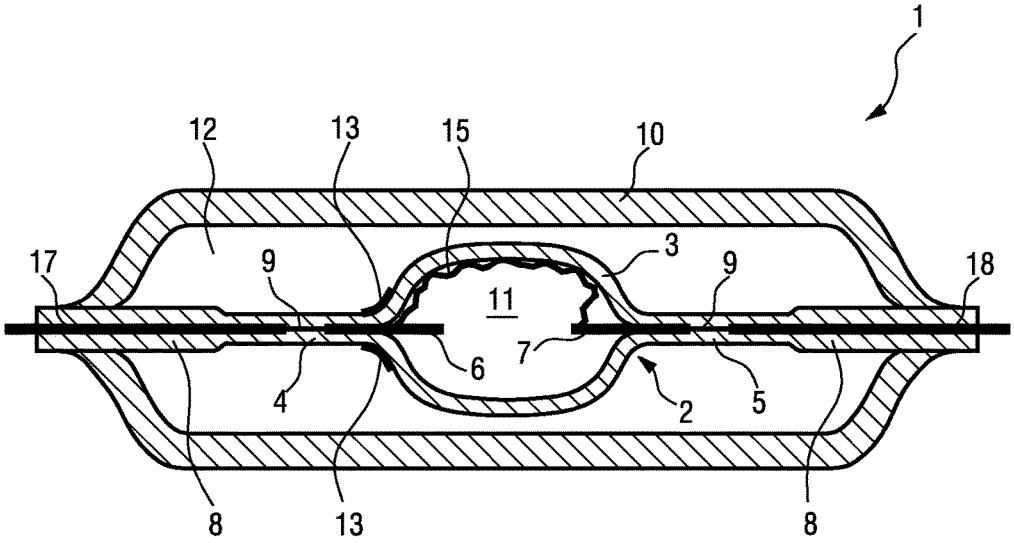
Figure 4:
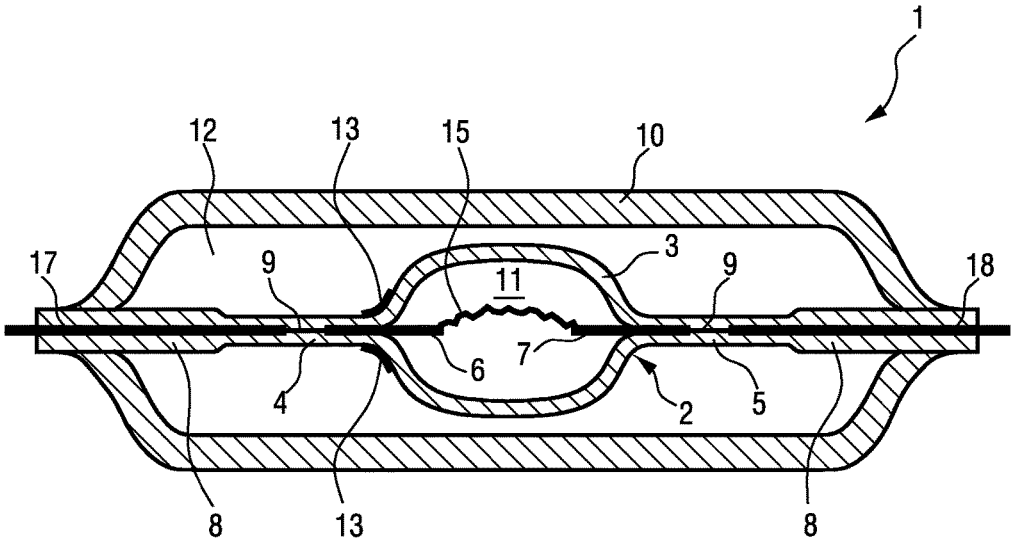
Figure 5:
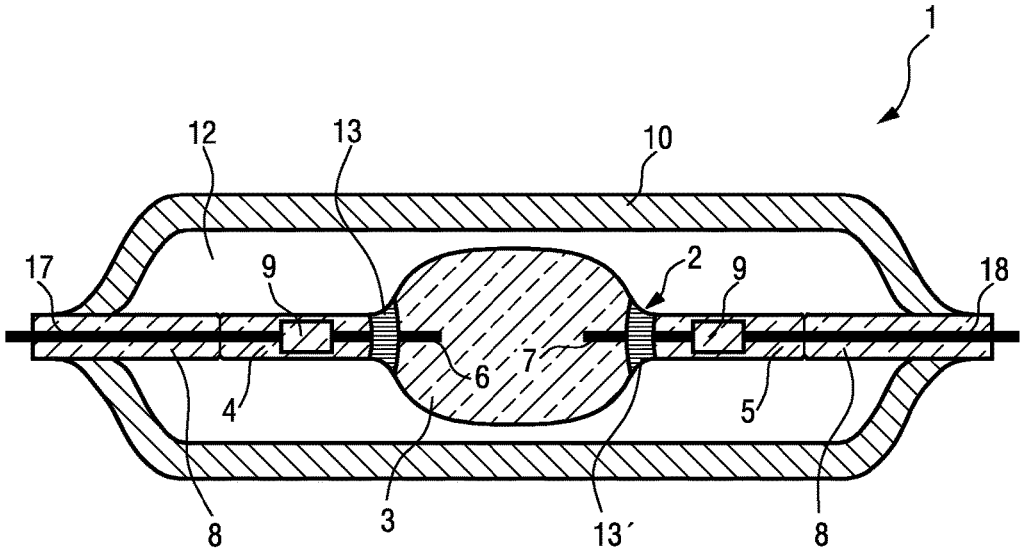
Figure 6:
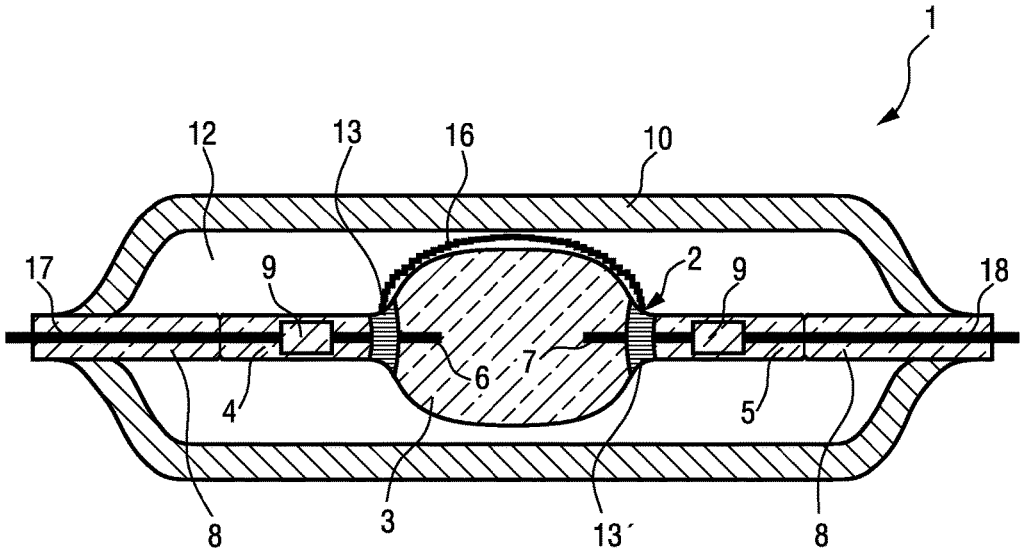
Figure 7:
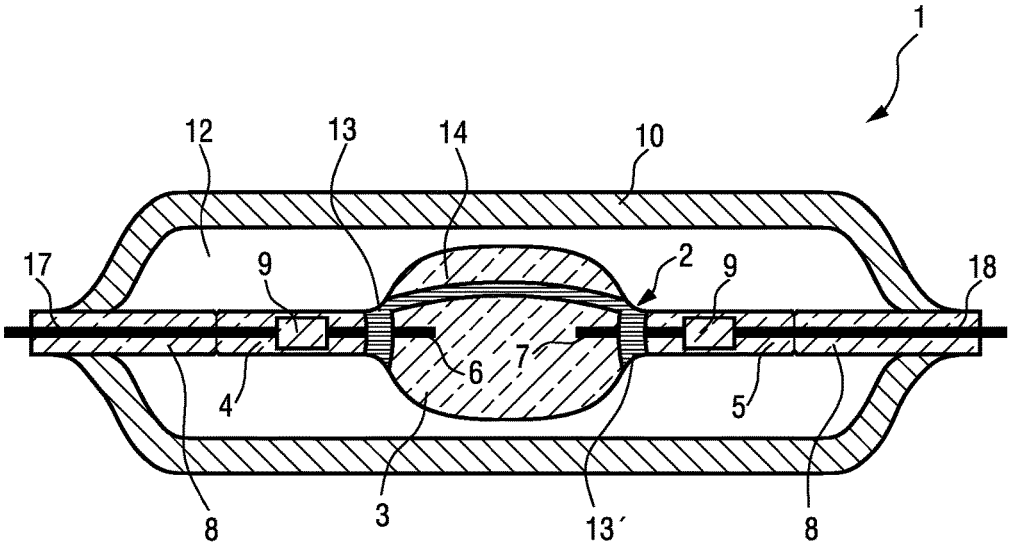
Figure 8:
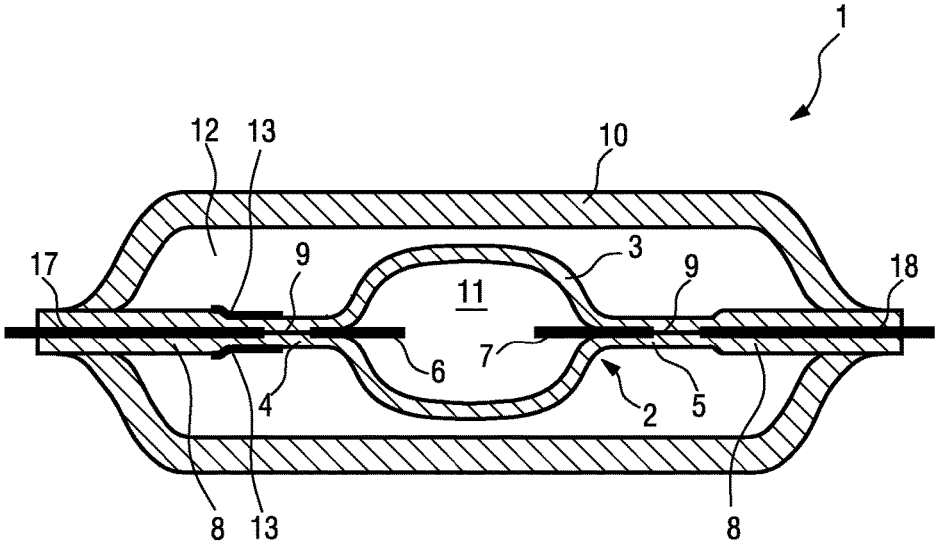
Figure 9:
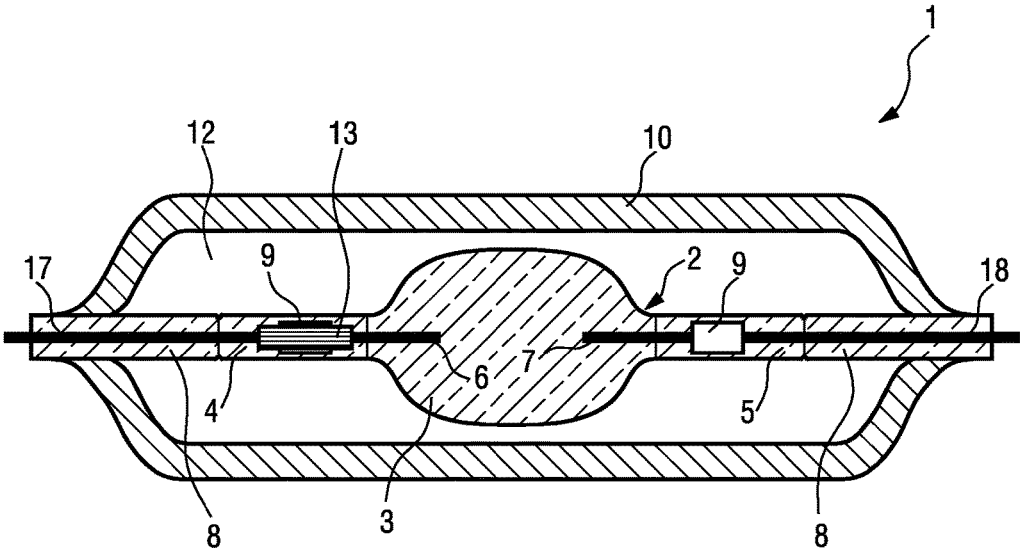

These and other aspects of the invention are apparent from and will be elucidated with reference to the embodiments described hereinafter. The same components are identified with identical reference numerals. In the drawings:

FIG. 1 is a diagrammatic side view of a first embodiment example of a gas discharge lamp according to the invention with associated lamp holder, where the gas discharge lamp is shown in cross section, FIG. 2 is a section through the gas discharge lamp according to FIG. 1 in a first phase during ignition of the discharge arc, FIG. 3 is a section through the gas discharge lamp according to FIGS. 1 and 2 in a second phase during ignition of the discharge arc, FIG. 4 is a section through the gas discharge lamp according to FIGS. 1 to 3 in stationary mode after ignition, FIG. 5 is a top view with a section through the outer bulb in a second embodiment example of a gas discharge lamp according to the invention, FIG. 6 is a view of a gas discharge lamp according to FIG. 5 with a gas filling between the inner and outer bulbs in a first ignition phase, FIG. 7 is a top view with a section through the outer bulb in a third embodiment example of a gas discharge lamp according to the invention, FIG. 8 is a section through a fourth embodiment of a gas discharge lamp according to the invention, FIG. 9 is a top view with a section through the outer bulb in a fifth embodiment of a gas discharge lamp according to the invention.

The embodiment example shown in the figures—without restricting the invention to this—is an MPXL lamp used for preference which is constructed in the conventional manner with an inner bulb 2 and an outer bulb 10 surrounding this inner bulb 2. The inner bulb 2 here comprises the actual discharge vessel (burner) 3 of quartz glass which on two opposite sides has quartz glass end pieces 8 molded on the discharge vessel 3. Immediately adjacent to the discharge vessel 3, the quartz glass end pieces 8 are formed as sealing sections 4, 5. Electrodes 6, 7 protrude from these sealing sections 4, 5 into the discharge vessel 3. In the sealing sections the electrodes 6, 7 are each connected with a relatively thin, short conductor film section 9 which in turn is connected at the other end with a supply line 17, 18. In the area of the sealing sections 4, 5 the quartz glass end pieces 8 are crimped together so that the conductor film sections 9 are tightly enclosed in the sealing sections 4, 5. The sealing sections 4, 5 are therefore normally referred to as "pinches". This ensures that the discharge vessel 3 is sealed airtight or gas-tight to the environment.

In the interior 11 of the discharge vessel 3 the inert gas is under relatively high pressure. Because of this inert gas between the two electrodes 6, 7 on ignition of the lamp a discharge arc forms which then in stationary operation can be maintained with a voltage which is very low in relation to the ignition voltage. Normally the ignition voltage is of the order of 20 kV and the operating voltage for stationary operation in the area of less than 100 V.

The outer bulb 10 serves primarily to screen the UV radiation occurring because of the physical processes in the discharge vessel 3 close to the desired light spectrum. Normally this outer bulb 10 is also made of quartz glass and connected at the ends with the quartz glass end pieces 8 of the inner bulb 2 through which the supply lines 17, 18 of the electrodes 6, 7 are guided outwards. The connecting points between the outer bulb 10 and the quartz glass end pieces 8 of the inner bulb 2 are normally called "rolls". Preferably this connection is designed gastight and the gap 12 between the inner bulb 2 and the outer bulb 10 is filled with a gas or gas mixture, where applicable also with air.

FIG. 1 shows how the lamp 1 is normally held in a base 21. The gas discharge lamp 1 is here connected via a holder 22 with the base 21 and with this forms a common lamp unit. It can thus be used in various types of headlamp which have a corresponding receptacle for the holder, in particular vehicle headlamps.

As shown in FIG. 1 the supply line 17 arranged on the base side electrode 6 is guided directly to the base 21. The conductor 18 connected with the electrode 7 lying remote from the base 21 is connected with an external electrical return line 19 which runs outside the outer bulb 10 past the lamp 1 back to the base 21. This return line 19 is guided in the part running parallel to the lamp bulb 12 within an insulating ceramic tube 20 which serves for support or mechanical stabilization of the return line 19.

As can be seen from FIG. 1, on the electrode 6 arranged in the vicinity of the base 21, on the outside on the inner bulb 2 directly in the transitional area between the discharge vessel 3 and the sealing section 4 in which the electrode 6 is connected with the supply line 17 with the conductor film 9 in between, is a conductive structure 13. This is a simple ring 13 of conductive material which is guided once about the inner bulb 2 along this transitional area. A top view of this conductive structure 13 is shown in FIG. 5. In FIG. 5 corresponding conductive structures 13, 13' are arranged symmetrically on the two electrodes 6, 7, where in contrast in FIG. 1 such a conductive ring 13 is arranged only about the electrode 6, close to the base, to which the high voltage is applied in the ignition process. The conductive structure 13 is insulated from other parts and thus not laid to a particular prespecified potential. The conductive ring 13 can comprise a simple coating, for example of a conductive paint such as palladium or a paint comprising individual palladium particles.

This conductive ring structure 13 ensures that the ignition voltage can be reduced substantially. The action mechanism of this ring structure 13 is shown in FIGS. 2, 3 and 4. On application of an electrical voltage to the electrodes 6, 7, the ring structure 13 modifies the electrical field created in the discharge vessel 3 so that, in a first phase, a discharge arc 15 is initially established from the electrode 6, subject to a high voltage, towards an adjacent wall section of the discharge vessel 3. In a further phase, this discharge arc 15 is propagated along the inside of the wall of the discharge vessel 3 as shown in FIG. 3. When finally the discharge arc 15 has reached the opposite electrode 7, as shown in FIG. 4 in a third step the discharge arc 15 forms directly between the electrodes. Although thus the conductive structure 13 arranged according to the invention on the outside of the inner bulb 3 ensures that the discharge arc 15 is first diverted along the wall of the discharge vessel 3 instead of traveling directly along the shortest connection between the two electrodes 6, 7, the ignition voltage can be substantially reduced by this procedure. The reason is that on a surface discharge along the wall, substantially better mechanisms can be used to generate free charge carriers. In a pure volume discharge without surface contact it is considerably more difficult to generate electrons and ions. When finally the discharge arc 15 traveling along the wall generates enough free charge carriers in the inert gas, the discharge arc 15 can easily form between the two electrodes 6, 7.

FIGS. 5 and 6 show a further variant of the invention which also leads to a substantial reduction in the ignition voltage. In this variant, corresponding ring structures 13, 13' showing a sufficient high conductivity are arranged about the two electrodes 6, 7. The space 12 between the inner bulb 3 and the outer bulb 10 is filled with argon or an argon mixture. The gas pressure lies below atmospheric pressure. With such a low gas pressure an ignition can occur between different potentials with relatively low voltage. As is evident from the cross sections shown in FIGS. 2 to 4, the conductive ring structures 13, 13' are arranged relatively close to the electrodes 6, 7. They are therefore capacitatively coupled with the electrodes 6, 7 concerned. If a voltage is applied to the electrodes 6, 7 this also leads to the creation of a potential difference between the two conductive ring structures 13, 13' arranged at opposite ends of the discharge vessel 3. If this potential difference is large enough, a discharge 16 occurs in the space 12 between the inner bulb 2 and the outer bulb 10 because of the relatively low gas pressure. This discharge 16 acts like a plasma antenna and causes further field changes in the discharge vessel 3 so that after the "predischarge" 16 in the outer bulb 10 the actual desired discharge is formed between the electrodes 6, 7. As soon as the discharge in the inner bulb 2 has ignited, the voltage between the conductive ring structures 13, 13' coupled merely capacitatively with the electrodes 6, 7 falls such that the discharge 16 in the outer bulb 10 is extinguished.

FIG. 7 shows a further variant in which the two conductive ring structures 13, 13' arranged symmetrical to each other about the respective electrodes 6, 7 are connected together by a thin, electrically conductive strip 14 running over the outside of the discharge vessel 3 preferably so that the two ring structures 13, 13' always have the same potential. The conductivity of the electrically conductive strip 14 is preferably sufficiently high, so as to ensure equalisation of the potentials of the annular structures. It has been found that this structure also helps improve the ignition behaviour.

In FIG. 8 a further embodiment is shown, which closely resembles the first embodiment shown in FIGS. 1 to 4. Here, however, the conductive ring structure 13 is applied to the end of the pinch 4 facing away from the discharge vessel 3, with the advantage that the temperature in that region is not so high. Furthermore, a conductive coating is used here which, as described above, comprises solitary conductive particles such as palladium.

In the embodiment shown in FIG. 9, such a coating is also used. However, instead of a ring, a conductive structure 13 in the form of strip is applied on the outside of the quartz glass end piece 8, along the longitudinal axis of the lamp in the region of the pinch 4 (over the conductor film 9).

Finally it is pointed out that the lamp constructions shown in the figures and the description are merely embodiment examples that can be varied by the person skilled in the art without leaving the scope of the invention.

For the sake of completeness it is also pointed out that the use of the indefinite article "a" or "an" does not exclude the possibility of the features concerned also being present in multiples.

The invention claimed is:

1. A gas discharge lamp comprising:

an inner bulb with a quartz glass discharge vessel and a first sealing section and a second sealing section arranged on the discharge vessel, a first electrode and a second electrode protruding from the respective first and second sealing sections into the discharge vessel which are each electrically connected in the respective first and second sealing sections with a conductor in order to supply current to the first and the second electrodes, an outer bulb which surrounds the discharge vessel leaving a cavity between the discharge vessel and the outer bulb, and a unitary conductive ring coating, the unitary conductive ring being arranged potential-free in surrounding relation about at least a portion of the first sealing section and in spaced relation from the discharge vessel on an outside of the inner bulb, said unitary conductive ring coating on said first sealing section insulated from said second sealing section, wherein the second sealing section has no conductive ring thereabout, the first sealing section ring, on application of a voltage to the first and the second electrodes, influencing the electrical field present in the area of the first electrode such that a discharge arc travels from the first electrode first in the direction of a section of a wall of the discharge vessel adjacent to the first electrode and then along the wall toward the second electrode.

2. A gas discharge lamp as claimed in claim 1, wherein the conductive ring comprises a coating applied to the inner bulb, the coating comprising small conductive areas and/or particles isolated from each other.

3. A gas discharge lamp as claimed in claim 1, wherein the cavity between the outer bulb and the discharge vessel is filled with a gas.

4. A gas discharge lamp as claimed in claim 3, wherein the gas is one of the group He, Ne, Ar, Kr, Xe, F2, Cl2, Br2, I2, N2, O2 or a mixture thereof.

5. A gas discharge lamp as claimed in claim 1, wherein a pressure in the cavity between the outer bulb and the discharge vessel lies between 0.1 kPa and 100 kPa, preferably between 40 kPa and 80 kPa.

6. A gas discharge lamp as claimed in claim 2, wherein the coating comprises palladium particles.

7. A gas discharge lamp, comprising:

an inner bulb with a glass discharge vessel and a first sealing section and a second sealing section arranged at opposing ends of said discharge vessel, a first electrode and a second electrode protruding from said respective first and second sealing sections into said discharge vessel, each of said first and second electrodes electrically connected in said respective first and second sealing sections with a conductor in order to supply current to said first and second electrodes, an outer bulb which surrounds said discharge vessel leaving a cavity between said discharge vessel and said outer bulb, a unitary conductive ring coating at a transitional area between said discharge vessel and said first sealing section arranged potential-free and in surrounding relation of at least a portion of said first sealing section, said unitary conductive ring coating on said transitional area being insulated from said second sealing section, wherein said second sealing section has a transitional surface which is free of conductive material, said first sealing section ring, on application of a voltage to said first and second electrodes, influencing the electrical field present in the area of said first electrode such that a discharge arc travels from said first electrode first in the direction of a section of a wall of the discharge vessel adjacent to said first electrode and then along said wall toward said second electrode.

* * * * *